US009413102B1

(12) United States Patent
Wright et al.

(10) Patent No.: US 9,413,102 B1
(45) Date of Patent: Aug. 9, 2016

(54) ELECTRICAL CONNECTOR ASSEMBLY FOR DATA TRACES ON A STRUCTURAL SURFACE

(71) Applicant: The Boeing Company, Chicago, IL (US)

(72) Inventors: Robert S. Wright, Seattle, WA (US); Jeffrey Lynn Duce, Maple Valley, WA (US); Robert Nye, Lynnwood, WA (US); Jason Yim, Bothell, WA (US)

(73) Assignee: The Boeing Company, Chicago, IL (US)

( * ) Notice: Subject to any disclaimer, the term of this patent is extended or adjusted under 35 U.S.C. 154(b) by 137 days.

(21) Appl. No.: 13/960,184

(22) Filed: Aug. 6, 2013

(51) Int. Cl.
*H01R 13/52* (2006.01)
*H01R 13/527* (2006.01)
*H01R 43/18* (2006.01)

(52) U.S. Cl.
CPC ..... *H01R 13/527* (2013.01); *H01R 43/18* (2013.01)

(58) Field of Classification Search
CPC ..... H01R 13/26; H01R 13/28; H01R 13/53; H01R 13/64; H01R 13/432; H01R 13/658; H01R 13/5219; H01R 13/5202; H01R 23/27; H01R 23/193; H01R 23/684; H01R 23/6833; H01R 43/18; H01R 13/514; H01R 13/527
USPC ..... 439/89, 267, 271, 291–298, 333; 285/189
See application file for complete search history.

(56) References Cited

U.S. PATENT DOCUMENTS

| | | | | | |
|---|---|---|---|---|---|
| 1,738,524 | A * | 12/1929 | Christopher | H01R 33/7664 | 313/49 |
| 4,235,500 | A * | 11/1980 | Belopavlovich et al. | | 439/495 |
| 4,697,863 | A * | 10/1987 | Galloway et al. | | 439/544 |
| 4,714,439 | A * | 12/1987 | Marabotto et al. | | 439/627 |
| 4,758,028 | A * | 7/1988 | Davies et al. | | 285/189 |
| 4,787,857 | A * | 11/1988 | Kretchmar et al. | | 439/189 |
| 5,338,231 | A * | 8/1994 | Wilhite | | 439/660 |
| 7,202,321 | B2 * | 4/2007 | Byrd et al. | | 528/26 |
| 2007/0212918 | A1 * | 9/2007 | Gruebel et al. | | 439/271 |

* cited by examiner

*Primary Examiner* — Amy Cohen Johnson
*Assistant Examiner* — Milagros Jeancharles
(74) *Attorney, Agent, or Firm* — Charles L. Moore; Moore & Van Allen PLLC

(57) ABSTRACT

An electrical connector assembly may include a connector body and a resilient spring contact configured to electrically contact a data trace formed on a structural surface. The resilient spring contact being enclosed within the connector body when the connector body is attached to the structural surface. The electrical connector assembly may also include a connector arrangement configured to electrically couple the resilient spring contact to a system.

22 Claims, 7 Drawing Sheets

ELECTRICAL CONNECTOR ASSEMBLY FOR DATA TRACES ON A STRUCTURAL SURFACE

FIELD

The present disclosure relates to electrical connectors, and more particularly to an electrical connector assembly for data traces formed on a structural surface.

BACKGROUND

Direct-write data traces or printed conductive traces or circuitry may be formed on metal, composite or other types of surfaces of structures of vehicles, such as aircraft, aerospace vehicles, terrestrial vehicles, watercraft and other vehicles or systems. Current electrical connectors that are configured to electrically connect to data traces on such structural surfaces and to transmit data signals from these data traces to other vehicle systems or components have several disadvantages. The electrical connectors are typically mechanically fastened to the structural surface or backing surface by screws, bolts or similar mechanical fasteners, that may not be ideally suitable for some structures, such as for example, a honeycomb or sandwich panel that may include a one or more layers of material on both sides of a layer of structural material that may include a honeycomb type structure or the like, as is commonly used in aircraft and aerospace vehicles, may be disposed between the one or more layers of material. Mechanically fastening electrical connectors to these structural surfaces can significantly increase the manufacturing costs and increase the weight of the vehicle. Additionally, fluids or moisture can infiltrate such electrical connectors at gaps between the connector shell and the structural surface. The moisture infiltration can damage the connector wiring and cause false signals to be transmitted to other systems of the vehicle.

SUMMARY

In accordance with an embodiment, an electrical connector assembly may include a connector body and a resilient spring contact configured to electrically contact a data trace formed on a structural surface. The resilient spring contact is enclosed within the connector body when the connector body is attached to the structural surface. The electrical connector assembly may also include a connector arrangement configured to electrically couple the resilient spring contact to a system.

In accordance with another embodiment, an electrical connector assembly may include a connector body and a plurality of resilient spring contacts. Each resilient spring contact may be configured to electrically contact a respective data trace of a plurality of data traces formed on a structural surface. The resilient spring contacts are enclosed within the connector body when the connector body is attached to the structural surface. The connector body is configured to be attached to the structural surface allowing ingress of the data traces and prevent infiltration of moisture into an interior of the connector body. The electrical connector may also include a connector arrangement configured to electrically couple the resilient spring contacts to a system of a vehicle.

In accordance with a further embodiment, a method for making an electrical connector may include forming a connector body and forming a resilient spring contact configured to electrically contact a data trace formed on a structural surface. The resilient spring contact is enclosed within the connector body when the connector body is attached to the structural surface. The method may also include attaching a connector arrangement to the connector body. The connector arrangement is configured to electrically couple the resilient spring contact to a system.

BRIEF DESCRIPTION OF THE SEVERAL VIEWS OF DRAWINGS

The following detailed description of embodiments refers to the accompanying drawings, which illustrate specific embodiments of the disclosure. Other embodiments having different structures and operations do not depart from the scope of the present disclosure.

DESCRIPTION

Figure 1A:
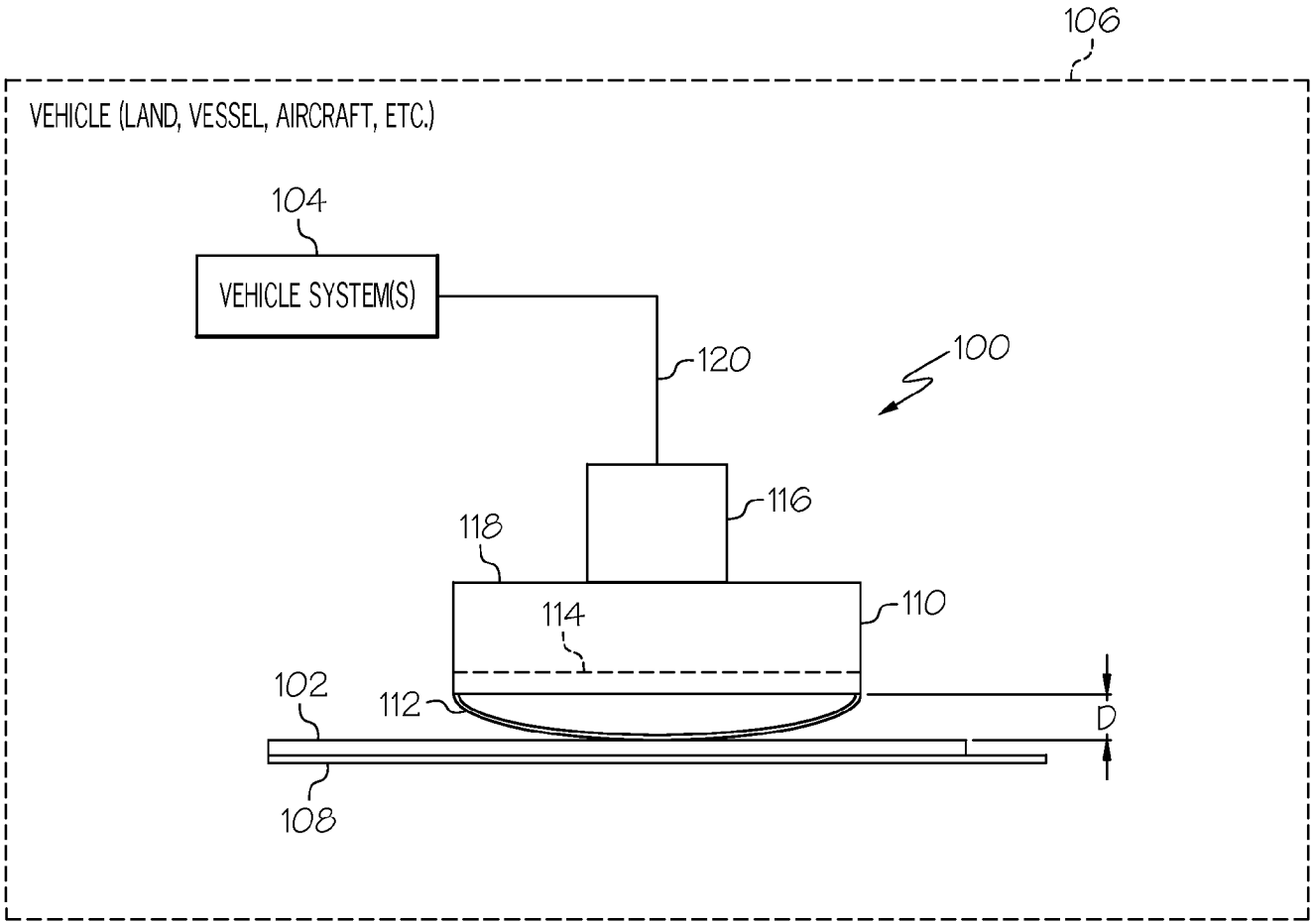
FIG. 1A is a side elevation view of an example of an electrical connector assembly for electrically connecting a data trace to a system of a vehicle in accordance with an embodiment of the present disclosure.

The following detailed description of embodiments refers to the accompanying drawings, which illustrate specific embodiments of the disclosure. Other embodiments having different structures and operations do not depart from the scope of the present disclosure. Like reference numerals may refer to the same element or component in the different drawings.

FIG. 1 is a side elevation view of an example of an electrical connector assembly 100 for electrically connecting a data trace 102 to a system 104 or systems of a vehicle 106 in accordance with an embodiment of the present disclosure. The vehicle 106 may be a land or terrestrial vehicle, a watercraft or vessel, an aircraft or aerospace vehicle or other vehicle or system that may utilize the electrical connector assembly 100 as described herein. The data trace 102 may be a direct-written data trace or printed circuit including an electrically conductive material. The data trace 102 may be formed as a linearly deposited trace or line of conductive material similar to that illustrated in FIGS. 2A and 2B, although the embodiments described herein may also be adapted for use with other configurations. The data trace 102 may be a single data trace or a plurality of data traces 204*a*-204*d* similar to that illustrated in FIGS. 2A, 2B, 5 and 6.

The data trace 102 may be deposited or formed on a structural surface 108. The structural surface 108 may be any type of structural surface. For example, the structural surface 108 may be (a non-exhaustive list) a backing structure on a removable item or panel, such as a thrust reverser or can cowl door of an aircraft. The structural surface 108 may also be a sandwich panel including a honeycomb structure interior portion similar to that previously described. The structural surface 108 may include a composite material, a metal, a metal alloy or other material.

The electrical connector assembly 100 may include a connector body 110 and a resilient spring contact 112 configured to electrically contact the data trace 102. The resilient spring contact 112 may be formed from an electrically conductive material or semiconductor material. As described in more detail herein, the resilient spring contact 112 may be retained within the connector body 110 by a retaining mechanism 114 (shown in phantom in FIG. 1A) which will be described in more detail with reference to FIGS. 2B and 6. The resilient spring contact 112 may be configured to extend a predetermined distance "D" below the connector body 110 prior to attachment of the connector body 110 to the structural surface 108. The resilient spring contact 112 will flexibly electrically contact the data trace 102 when the connector body 110 is placed on the structural surface 108 for attaching the connector body 110 to the structural surface 108. The resilient spring contact 112 in electrical contact with the data trace 102 will flex into the connector body 110 and will be enclosed within the connector body 110 when the connector body 110 is attached to the structural surface 108 as will be described in more detail with reference to FIG. 1B.

The electrical connector assembly 100 may also include a connector arrangement 116 or plug mounted in an upper wall 118 of the connector body 110 opposite the resilient spring contact 112. The connector arrangement 116 may be a threaded cannon-plug connector that may be screwed into a matingly threaded opening formed in the upper wall 118 of the connector body 110. Other types of connector plugs may also be used for the connector arrangement 116 depending upon the particular application. Signal wiring 120 may be connected from the connector arrangement 116 to the vehicle system 104 for transmitting data signals from the data trace 102 through the electrical connector assembly 100 to the vehicle system 104.

Figure 1B:
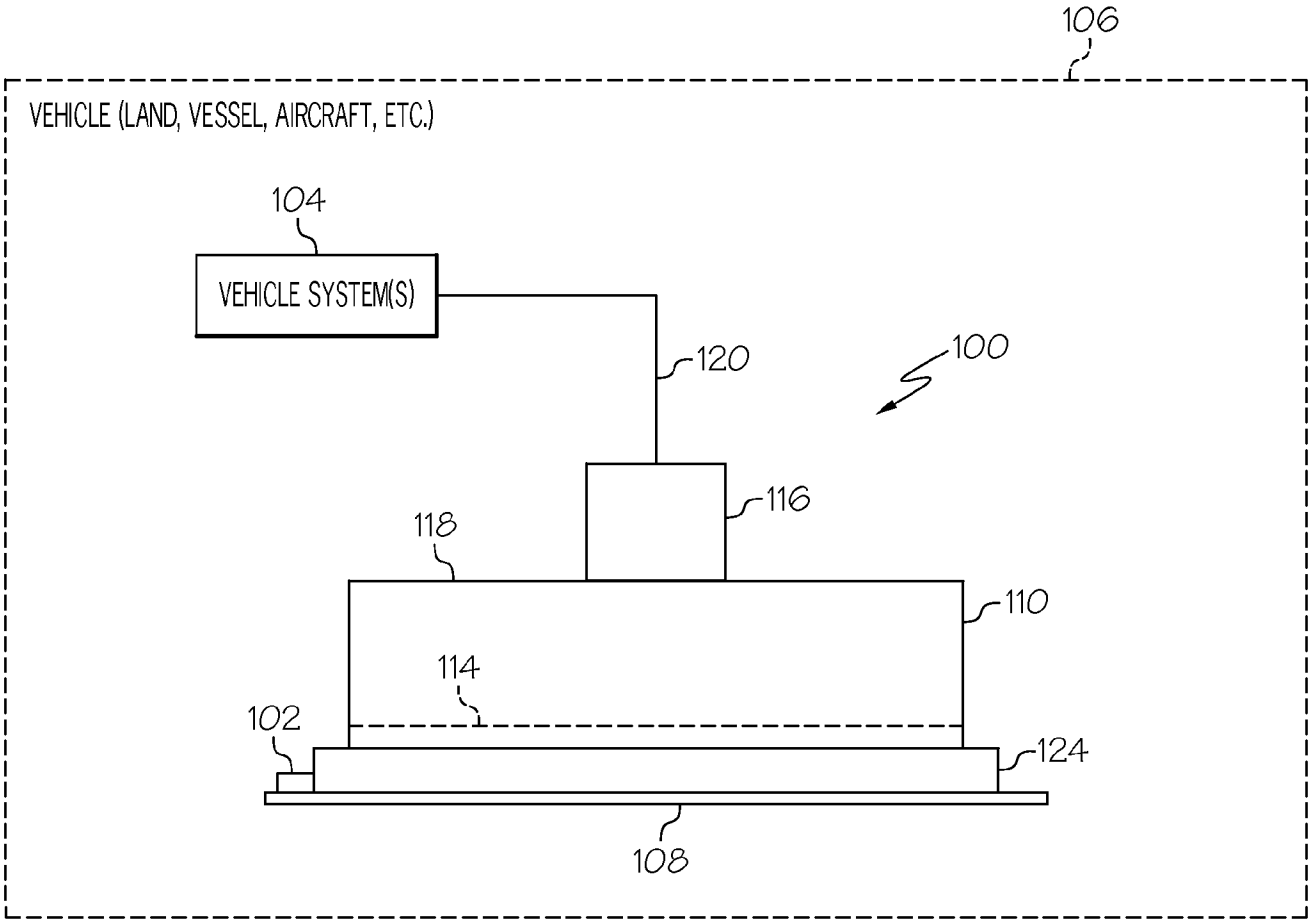
FIG. 1B is a side elevation view of the electrical connector assembly of FIG. 1 showing the electrical connector assembly attached to a structural surface of a vehicle system in accordance with an embodiment of the present disclosure.

FIG. 1B is a side elevation view of the electrical connector assembly 100 of FIG. 1A showing the electrical connector assembly 100 attached to the structural surface 108 in accordance with an embodiment of the present disclosure. The electrical connector assembly 100 may be attached to the structural surface 108 by any suitable mechanism that may prevent fluids or moisture from entering an interior of the connector body 110. For example, a seal 124 may be formed between the bottom of the connector body 110 and the structural surface 108. The seal 124 is configured to prevent the infiltration of moisture within the connector body 110 when the connector body 110 is attached to the structural surface 108. The seal 124 may include firewall sealant depending upon the application to protect the resilient spring contact 112 from temperatures that could damage the resilient spring contacts 112. In another embodiment, the firewall sealant may be used in conjunction with the seal 124 to protect the resilient spring contact 112 from damage due to high temperatures.

In another embodiment, the seal 124 may be a fillet seal or other type seal between the connector body 110 and the structural surface 108 configured to prevent infiltration of moisture within the connector body 110.

Figure 2A:
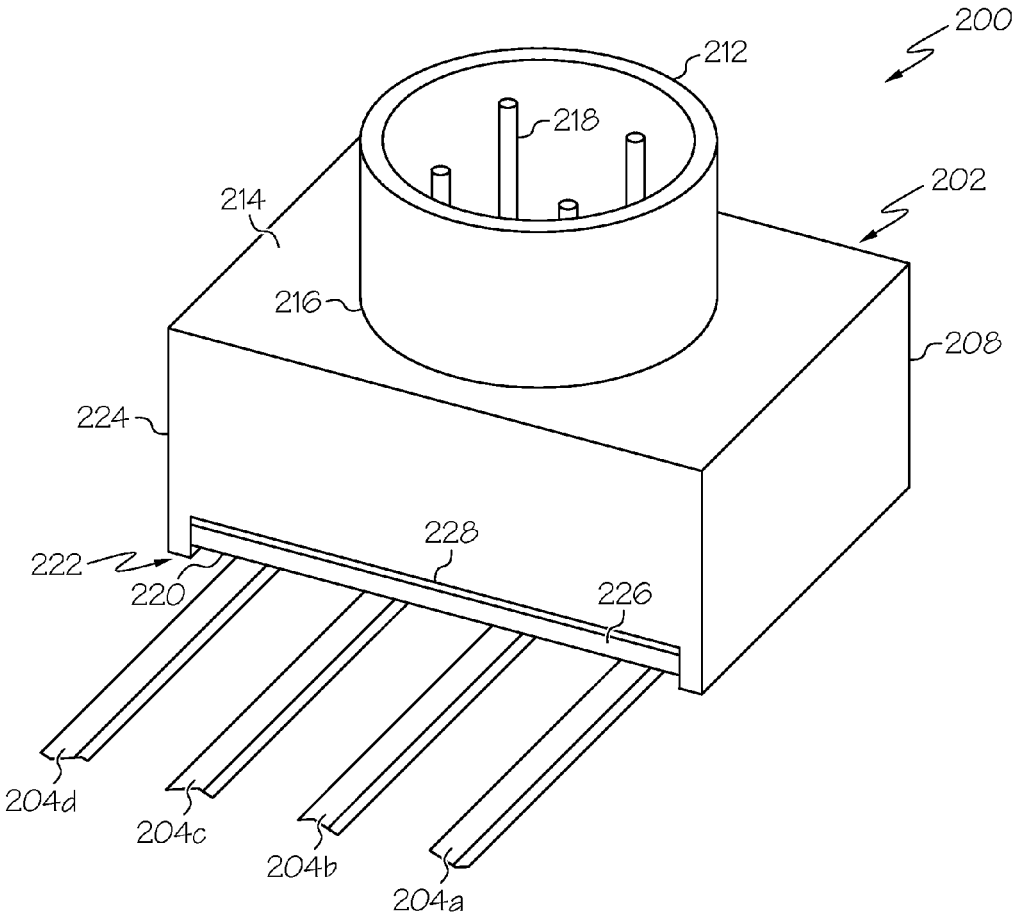
FIG. 2A is a perspective view of an upper portion of an example of an electrical connector assembly for electrically connecting a data trace to a vehicle system in accordance with an embodiment of the present disclosure.
Figure 2B:
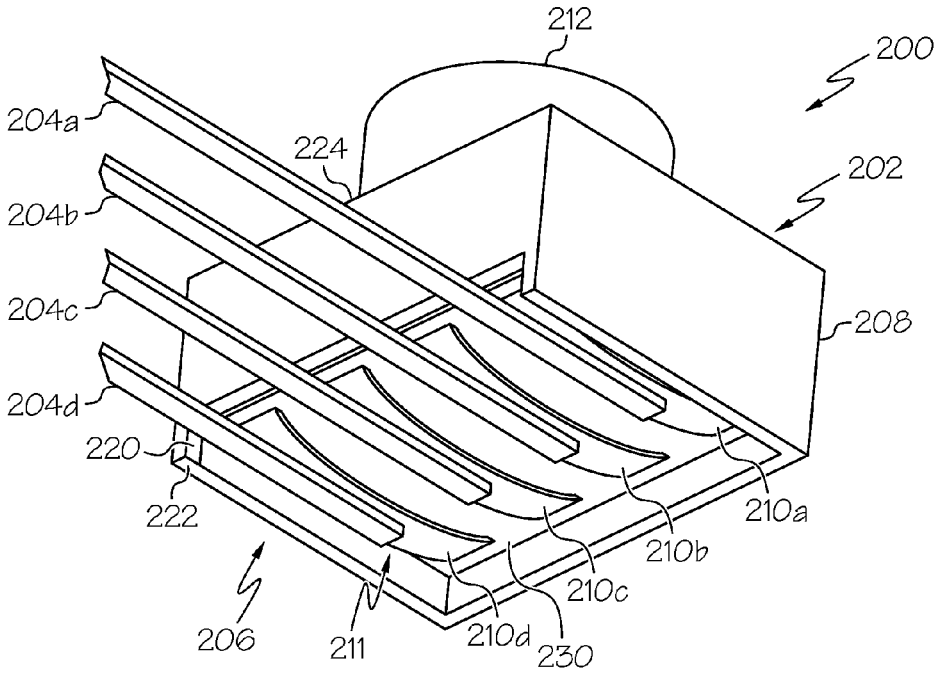
FIG. 2B is a perspective view of an underside of the electrical connector assembly of FIG. 2A.

Referring also to FIGS. 2A and 2B, FIG. 2A is a perspective view of an upper portion 200 of an example of an electrical connector assembly 202 for electrically connecting an electrically conductive data trace 204*a* or plurality of data traces 204*a*-204*d* to a vehicle system, such as vehicle system 104 in FIG. 1 in accordance with an embodiment of the present disclosure. FIG. 2B is a perspective view of an underside 206 of the electrical connector assembly 202 of FIG. 2A. While four conductive data traces 204*a*-204*d* are shown in FIGS. 2A and 2B for purposes of explanation, the electrical connector assembly 202 may be configured to contact any number of data traces. The electrical connector assembly 202 may be used for the electrical connector assembly 100 in FIG. 1. The connector assembly 202 may include a connector body 208 similar to the connector body 110 in FIG. 1. The connector body 208 may be substantially box shaped similar to that illustrated in FIGS. 2A and 2B, although other shapes of the connector body 208 may also be used depending upon the particular application. For example, the connector body 208 may be cylindrically shaped or multi-sided.

As best shown in FIG. 2B, the electrical connector assembly 202 may include a plurality of resilient spring contacts 210*a*-210*d* each configured to electrically contact a respective data trace 204*a*-204*d* formed on a structural surface (not shown in FIGS. 2A and 2B), such as structural surface 108 in FIG. 1. The resilient spring contacts 210*a*-210*d* are formed from an electrically conductive material or semiconductor material. The resilient spring contacts 210*a*-210*d* will be enclosed within the connector body 208 when the connector body 208 is attached to the structural surface. As described in more detail herein, the connector body 208 is configured to be attached to the structural surface allowing ingress of the data traces 204*a*-204*d* and also prevent infiltration of moisture into an interior 211 of the connector body 208.

The electrical connector assembly 202 may also include a connector arrangement 212 mounted in an upper wall 214 of the connector body 208. Similar to that previously described, the connector arrangement 212 may be a threaded cannon-plug connector or similar connector that may be attached to the connector body 208 by screwing into a matingly threaded opening 216 formed in the upper wall 214 of the connector body 208. Accordingly, the connector arrangement 212 may be removably attached to the connector body 208. Other types of connector plugs could also be used for the connector arrangement 212. The connector arrangement 212 or plug may include one or more connector pins 218 (FIG. 2A) that are each electrically coupled to a respective one of the resilient spring contacts 210*a*-210*d*. The connector arrangement 212 may be configured to receive a mating connector arrangement (not shown in FIGS. 2A and 2B) for electrically coupling the data traces 204*a*-204*d* to a system of a vehicle similar to that previously described.

A gap 220 may be formed in a base portion 222 of a side wall 224 of the connector body 208 for ingress of the data traces 204*a*-204*d* into an interior 211 (FIG. 2B) of the connector body 208 when the connector body 208 is attached to the structural surface. A seal 226 (FIG. 2A) may be disposed in the gap 220. The seal 226 is configured to prevent moisture from entering into the interior 211 of the connector body 208. The seal 226 may be made from any type of material capable of forming a flexible removable seal that can prevent infiltration of moisture within the connector body 208 when the connector body 208 is attached to a structural surface, such as the structural surface 108 in FIG. 1. For example, the seal 226 may include a compression elastomeric material that may form a bulb-type seal, compressible tube-type seal or other type seal. A firewall sealant 228 may also be in conjunction with the seal 226 depending upon the application.

The electrical connector assembly 200 may also include a retaining mechanism 230 to retain the resilient spring contacts 210*a*-210*d* electrically separate from one another and in a position relative to one another for aligning electrical contact with the respective data traces 204*a*-204*d* on the structural surface. The retaining mechanism 230 may be a dielectric frame or plate that may be attached within an interior 211 of the connector body 208 by any suitable arrangement. For example, the retaining mechanism may be attached within the interior 211 of the connector body 208 by an adhesive, welding, brazing, bonding, a fastener or other mechanical mechanism. The dielectric plate or fame may be similar to the dielectric frame or plate described with reference to FIG. 6.

Figure 3:
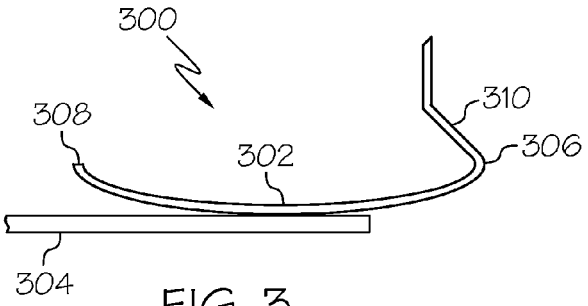
FIG. 3 is a side elevation view of an example of a resilient spring contact in accordance with an embodiment of the present disclosure.

FIG. 3 is a side elevation view of an example of a resilient spring contact 300 in accordance with an embodiment of the present disclosure. The resilient spring contact 300 may be used for the resilient spring contacts 210*a*-210*d* in FIGS. 2A and 2B and or the resilient spring contact 112 in FIG. 1. The resilient spring contact 300 may include a substantially U-shaped band 302. The U-shaped band 302 may be described as being substantially U-shaped in that the U-shaped band 302 may form a flattened U-shape or may define a convex shape with upturned ends 306 and 308. Similar to that previously described, the substantially U-shaped band 302 may be made from an electrically conductive material or semiconductor material. The substantially U-shaped band 302 may be configured to flex to conform to the data trace 304 and make electrical contact with the data trace 304 when a connector body, such as connector body 208 in FIGS. 2A and 2B or connector body 110 in FIG. 1 are attached to a structural surface similar to that previously described.

A contact connecting link 310 may be attached to one end 306 of the substantially U-shaped band 302. The contact connecting link 310 may be configured to electrically connect the U-shaped band 302 to a connector pin of a connector arrangement, such as connector pin 218 of connector arrangement 212 in FIG. 2A, or to electrically connect the U-shaped band 302 to some other electrical connection within an electrical connector assembly.

Figure 4:
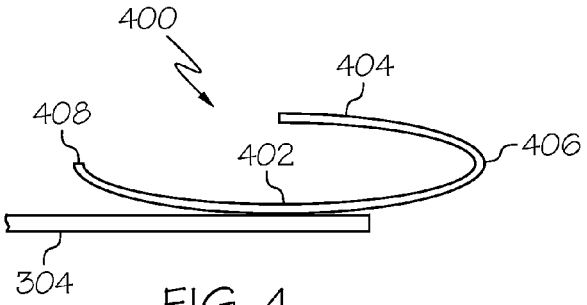
FIG. 4 is a side elevation view of an example of a resilient spring contact in accordance with another embodiment of the present disclosure.

FIG. 4 is a side elevation view of an example of a resilient spring contact 400 in accordance with another embodiment of the present disclosure. The resilient spring contact 400 may be similar to the substantially U-shaped band 302 shown in FIG. 3 and may include a substantially U-shaped band 402 with ends 406 and 408. The end 408 of the U-shaped band 402 may be free or not connected to anything. A loop back member 404 may extend from the end 406 of the U-shaped band 402 back over at least a portion of the substantially U-shaped band 402. For example, the loop back member 404 may extend back about half the length of the U-shaped band 402 from the end 406. The loop back member 404 may be formed by an extension of the U-shaped band 402 being folded or bent back over the U-shaped band 402, or the loop back member 404 may be attached to the end 406 of the U-shaped band 402. The loop back member 404 may be attached to the end 406 of the U-shaped band 402 by brazing, bonding, welding or other suitable attachment mechanism.

Figure 5:
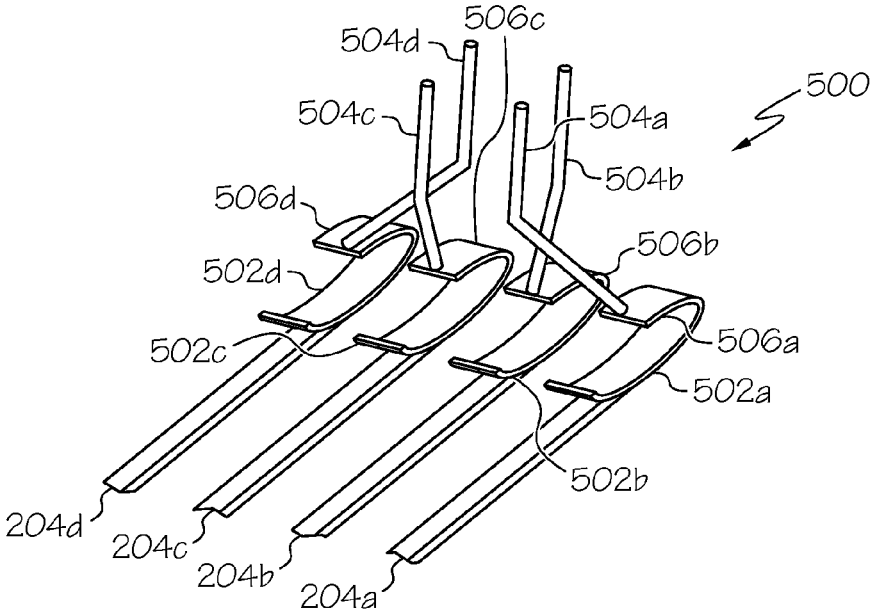
FIG. 5 is a perspective view of an example of an assembly of resilient spring contacts and contact connecting links in accordance with an embodiment of the present disclosure.

Referring also to FIG. 5, FIG. 5 is a perspective view of an example of an assembly 500 of resilient spring contacts 502*a*-502*d* and contact connecting links 504*a*-504*d* in accordance with an embodiment of the present disclosure. The resilient spring contacts 502*a*-502*d* may each be similar to the resilient spring contact 400 in FIG. 4. A contact connecting link 504*a*-504*d* may be electrically connected to each respective resilient spring contact 502*a*-502*d* by respectively connecting the contact connecting link 504*a*-504*d* to the loop back member 506*a*-506*d* of each resilient spring contact 502*a*-502*d* by any suitable attachment mechanism. For example, the contact connecting links 504*a*-504*d* may be respectively electrically connected to each respective loop back member 502*a*-502*d* by brazing, bonding, welding or other suitable attachment arrangement. Each contact connecting link 504*a*-504*d* may be configured to electrically connect an associated U-shaped band or resilient spring contact 502*a*-502*d* to a connector pin of a connector arrangement or connector plug, such as connector pin 218 of connector arrangement 212 in FIG. 2A or to electrically connect the respective resilient spring contacts 502*a*-502*d* to some other electrical connection within an electrical connector assembly, such as electrical connector assembly 200.

Figure 6:
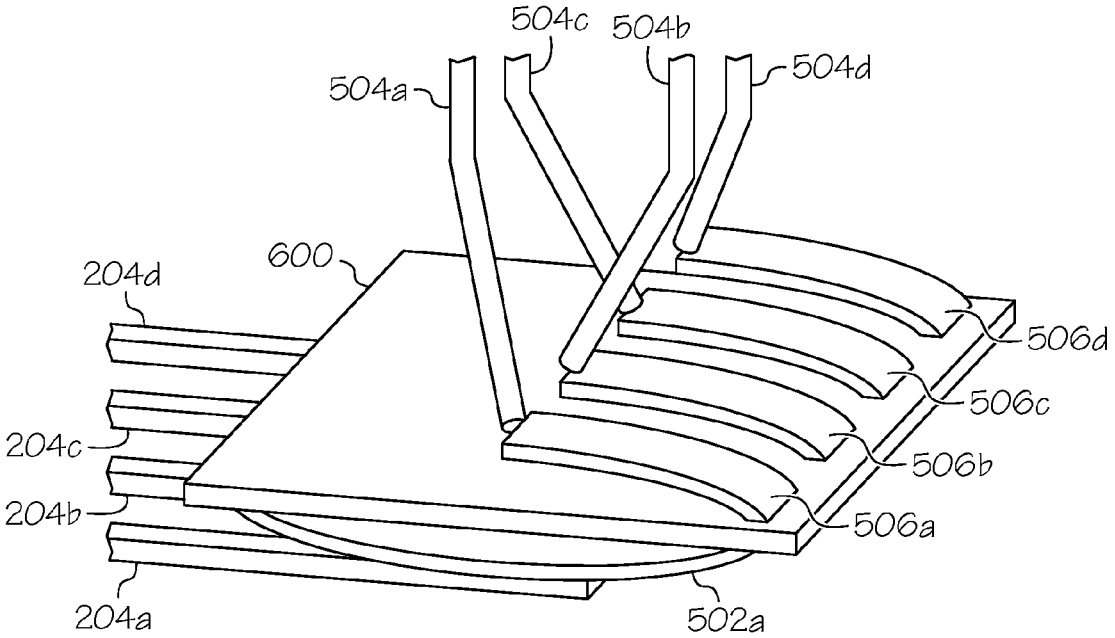
FIG. 6 is a perspective view of an example of dielectric frame or plate assembly with resilient spring contacts and contact connecting links in accordance with an embodiment of the present disclosure.

FIG. 6 is a perspective view of an example of dielectric frame 600 or plate assembled with the resilient spring contacts 502*a*-502*d* and associated contact connecting links 504*a*-504*d* in accordance with an embodiment of the present disclosure. The dielectric frame 600 may be configured to retain the resilient spring contacts 502*a*-502*d* electrically separate from one another and in a position relative to one another for aligning electrical contact with the respective data traces 204*a*-204*d* on the structural surface, such as structural surface 108 in FIG. 1. Similar to that previously described, the dielectric frame 600 may define a retaining mechanism for the resilient spring contacts 502*a* and 502*d* that can be attached within the connector body, such as connector body 208 in FIGS. 2A and 2B.

Figure 7A:
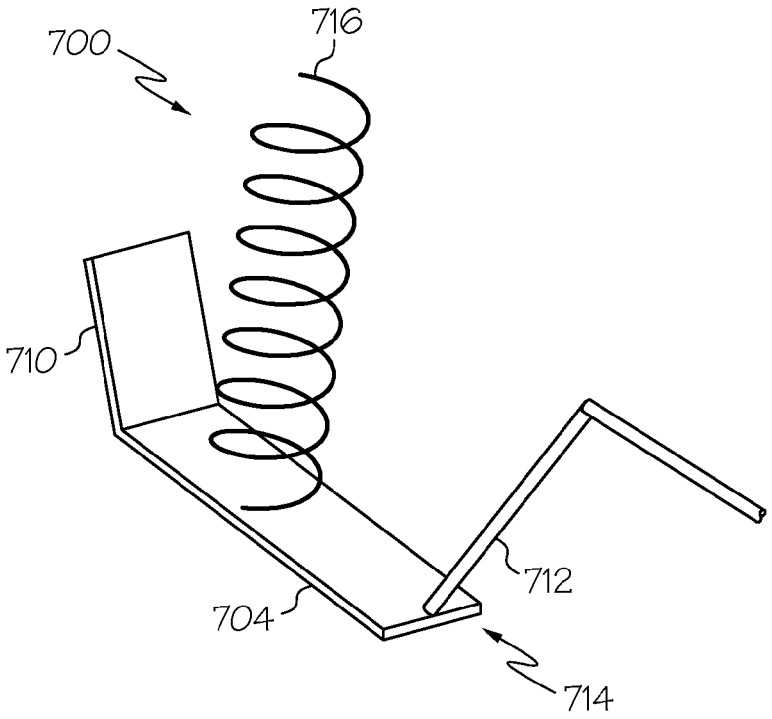
FIG. 7A is a perspective view of an example of a resilient spring contact in accordance with another embodiment of the disclosure.
Figure 7B:
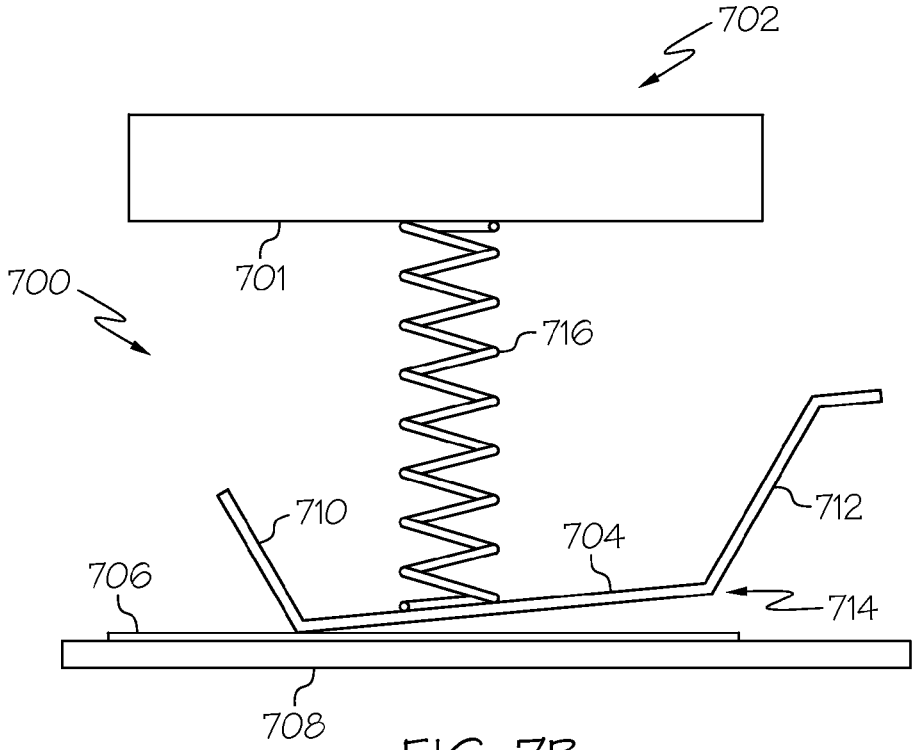
FIG. 7B is a side elevation view of the exemplary resilient spring contact of FIG. 7A and portion of a connector body.

FIG. 7A is a perspective view of an example of a resilient spring contact 700 in accordance with another embodiment of the disclosure. While a single resilient contact spring 700 is shown in FIG. 7A for purposes of explanation, any number of resilient contact springs may be used in a particular electrical connector assembly depending upon the number of conductive data traces that may need to be electrically contacted. Referring also to FIG. 7B, FIG. 7B is a side elevation view of the exemplary resilient spring contact 700 of FIG. 7A and portion of an upper wall 701 of a connector body 702. The resilient spring contact 700 may include a leaf-style contact pad 704 configured to electrically contact a conductive data trace 706 on structural surface 708. The resilient spring contact 700 is made from an electrically conductive material or semiconductive material. The resilient spring contact 700 may include a free-end portion 710 connected to one end of the leaf-style contact pad 704. The free-end portion 710 is not connected or coupled to anything within the connector body 702. The free-end portion 710 may extend from the leaf-style contact pad 704 at some predetermined angle away from the data trace 706 when the connector body is attached to the structural surface 714. An opposite end of the leaf-style contact pad 704 may be pivotably or flexibly, electrically connected or coupled to a connector link 712. The connector link 712 may electrically connect the resilient spring contact 700 to a connector pin of a connector arrangement or connector plug. The connector arrangement and pin may be similar to the connector arrangement 212 and connector pin 218 described with reference to FIG. 2A. The connector link 712 may be electrically coupled to the leaf-style contact pad 704 by a hinge arrangement 714 or other mechanism that allows the leaf-style contact pad 704 to pivot relative to the connector link 712 for making electrical contact with the conductive data trace 706 when the connector body 702 is attached to the structural surface 708.

A coil spring 716 or other type spring may be disposed between the leaf-style contact pad 704 and the upper wall 701 of the connector body 702. The coil spring 716 biases the leaf-style contact pad 704 against the data trace 706 to insure an electrical connection between the resilient spring connector 700 and the data trace 706 when the connector body 702 is attached to the structural surface 708. The coil spring 716 is electrically isolated from the leaf-style contact pad 704. For example, a layer of insulation material may be disposed on a surface of the contact pad 704 where the coil spring 716 contacts the contact pad 704 if the coil spring 716 is made from a conductive material. The coil spring 716 could also be made from a non-conductive material.

Figure 8:
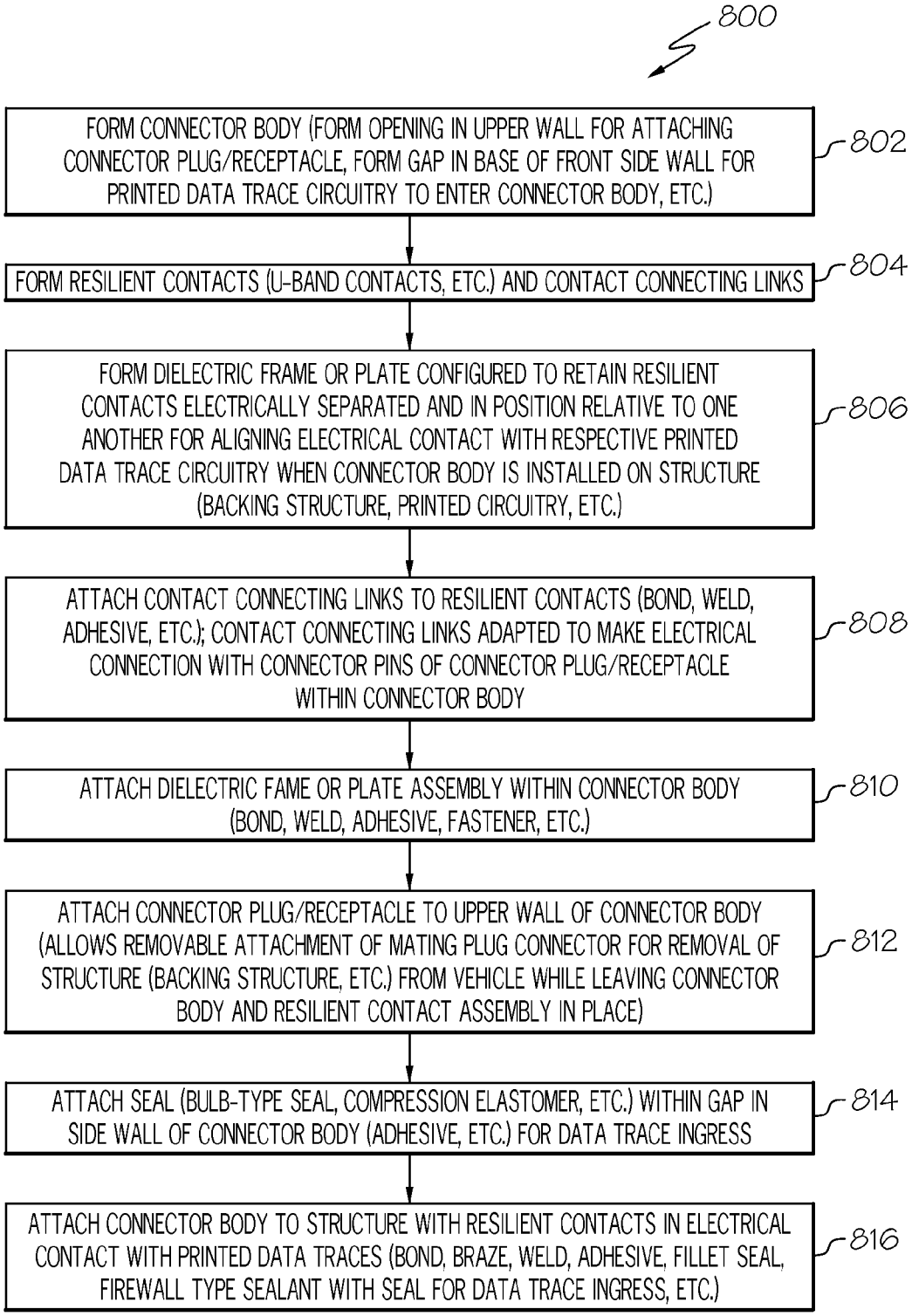
FIG. 8 is a flow chart of an example of a method for making an electrical connector and attaching the electrical connector to a structural surface in accordance with an embodiment of the present disclosure.

FIG. 8 is a flow chart of an example of a method 800 for making an electrical connector assembly and attaching the electrical connector to a structural surface in accordance with an embodiment of the present disclosure. The method 800 may be used to form the electrical connector assembly 100 of FIG. 1, the electrical connector assembly 200 of FIGS. 2A and 2B, or an electrical connector assembly using the resilient spring contacts 700 in FIGS. 7A and 7B, and to attach the electrical connector assembly to a structural surface similar to that illustrated in FIG. 1B. In block 802, a connector body may be formed. An opening may be formed in an upper wall of the connector body for attaching a connector arrangement, connector plug or receptacle similar to that previously described. A gap may be formed in a base portion of a front side wall for direct-write or printed data traces to enter into the connector body.

In block 804, one or more resilient spring contacts may be formed. The resilient spring contacts may be substantially U-shaped contacts or bands similar to those described with reference to FIGS. 3 and 4 or similar to resilient spring contact 700 of FIG. 7A and 7B. Contact connecting links similar to contact connecting links 504*a*-504*d* described with reference to FIGS. 5 and 6 may also be formed.

In block 806, a dielectric frame or plate may be formed. The dielectric frame or plate may be similar to the dielectric plate 600 described with reference to FIG. 6. The dielectric frame or plate may be configured to retain the resilient contacts electrically separated from one another and in a position relative to one another for aligning electrical contact with a respective printed data trace when the connector body is installed on the structural surface similar to that previously described.

In block 808, contact connecting links may be attached to the resilient contacts by any suitable mechanism. For example, each contact connecting link may be attached to a respective resilient contact by bonding, brazing, welding, an adhesive, or other suitable means. Each contact connecting link is configured to make an electrical connection between an associated resilient spring contact and a respective connector pin of the connector arrangement or receptacle within the connector body.

In block 810, the dielectric frame or plate assembly may be attached within the connector body. The dielectric frame or plate assembly may be attached within the connector body by any suitable mechanism, such as by bonding, brazing, welding, an adhesive, a fastener or other means.

In block 812, a connector arrangement, plug or receptacle may be attached to the opening in the upper wall of the connector body. The connector arrangement or receptacle permits removable attachment of a mating connector arrangement or plug for removal of a structure on which the electrical connector assembly may be attached while leaving the electrical connector assembly attached to the surface of the structure with resilient spring contacts remaining in contact with the data traces on the surface of the structure. Similar to that previously described, the structure may be a backing structure of a component or system of an aircraft, such as a thrust reverser or can cowl door.

In block 814, a seal may be attached within a gap in the front side wall of the connector body. The seal may be a compression elastomeric material or other type material capable of forming a seal to prevent moisture infiltration into the connector body. The seal may form a bulb-type seal within the gap. The gap and seal permit entry for the data traces into the connector body. The seal may be attached within the gap by any suitable mechanism, such as an adhesive or other means. A firewall sealant may be used in conjunction with the seal as previously described.

In block 816, the connector body may be attached to a surface of the structure with each resilient spring contact in electrical contact with a respective printed or direct-write data trace. Similar to that previously described, the connector body may be attached to the structure by any suitable mechanism. A seal or fillet seal may be formed between the connector body and the structural surface to prevent moisture infiltration into an interior of the connector body. A firewall type sealant may be used or may be used in conjunction with the seal.

While the operations or steps in FIG. 8 are illustrated and described in a certain sequence, the present invention is not intended to be limited by the sequence or order illustrated. The steps and operations may be performed in any order unless otherwise specified. Some operations or steps may also be performed simultaneously or combined.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Although specific embodiments have been illustrated and described herein, those of ordinary skill in the art appreciate that any arrangement which is calculated to achieve the same purpose may be substituted for the specific embodiments shown and that the embodiments herein have other applications in other environments. This application is intended to cover any adaptations or variations of the present disclosure. The following claims are in no way intended to limit the scope of the disclosure to the specific embodiments described herein.

What is claimed is:

1. An electrical connector assembly, comprising:

a connector body;

a resilient spring contact configured to electrically contact a data trace formed on a structural surface, the resilient spring contact being enclosed within the connector body when the connector body is attached to the structural surface and the resilient spring contact electrically contacts the data trace within the connector body;

a gap formed in a base portion of a side wall of the connector body for ingress of the data trace into an interior of the connector body, the gap existing between a bottom edge of the side wall and the structural surface when the connector body is attached to the structural surface; and a connector arrangement configured to electrically couple the resilient spring contact to a system.

2. The electrical connector assembly of claim 1, further comprising a seal configured to prevent infiltration of moisture within the connector body when the connector body is attached to the structural surface and the resilient spring contact is enclosed within the connector body.

3. The electrical connector assembly of claim 2, further comprising a firewall sealant associated with the seal.

4. The electrical connector assembly of claim 1, further comprising a fillet seal between the connector body and the structural surface configured to prevent infiltration of moisture within the connector body when the connector body is attached to the structural surface and the resilient spring contact is enclosed within the connector body.

5. The electrical connector assembly of claim 1, further comprising a seal disposed in the gap, the seal being configured to prevent moisture from entering into an interior of the connector body.

6. The electrical connector assembly of claim 5, wherein the seal comprises a bulb-type seal.

7. The electrical connector assembly of claim 5, wherein the seal comprises a compression elastomeric material.

8. The electrical connector assembly of claim 1, further comprising a firewall type sealant associated with the seal.

9. The electrical connector assembly of claim 1, wherein the resilient spring contact comprises a U-shaped band that is configured to flex to conform to the data trace and make electrical contact with the data trace.

10. The electrical connector assembly of claim 9, further comprising a contact connecting link attached to the substantially U-shaped band, the contact connecting link being configured to electrically connect the U-shaped band to a connector pin of the connector arrangement.

11. The electrical connector assembly of claim 9, wherein the resilient spring contact further comprises a loop back member extending from one of the ends of the substantially U-shaped band back over at least a portion of the U-shaped band.

12. The electrical connector assembly of claim 11, further comprising a contact connecting link attached to the loop back member, the contact connecting link being configured to electrically connect the U-shaped band to a connector pin of the connector arrangement.

13. The electrical connector assembly of claim 1, further comprising:

a plurality of resilient spring contacts each configured to electrically contact a respective one of a plurality of data traces formed on the structural surface, the resilient spring contacts being enclosed within the connector body when the connector body is attached to the structural surface; and a dielectric frame configured to retain the resilient spring contacts electrically separate from one another and in a position relative to one another for aligning electrical contact with the respective data traces on the structural surface.

14. The electrical connector assembly of claim 1, wherein the resilient spring contact comprises:

a contact pad configured to electrically contact the data trace; and a spring to bias the contact pad against the data trace when the connector body is attached to the structural surface.

15. An electrical connector assembly, comprising:

a connector body;

a plurality of resilient spring contacts each configured to electrically contact a respective data trace of a plurality of data traces formed on a structural surface, the resilient spring contacts being enclosed within the connector body when the connector body is attached to the structural surface and each of the plurality of resilient spring contacts electrically contact the respective data trace within the connector body, wherein the connector body is configured to be attached to the structural surface allowing ingress of the data traces and preventing infiltration of moisture into an interior of the connector body;

a gap formed in a base portion of a side wall of the connector body for ingress of the data trace into an interior of the connector body, the gap existing between a bottom edge of the side wall and the structural surface when the connector body is attached to the structural surface; and a connector arrangement configured to couple the resilient spring contacts to a system of a vehicle.

16. The electrical connector of claim 15, further comprising a dielectric frame configured to retain the resilient spring contacts electrically separate from one another and in a position relative to one another for aligning electrical contact with the respective data traces on the structural surface.

17. The electrical connector of claim 15, wherein the resilient spring contact comprises a substantially U-shaped band that is configured to flex to conform to the data trace and make electrical contact with the data trace.

18. A method for making an electrical connector, comprising:

forming a connector body;

forming a resilient spring contact configured to electrically contact a data trace formed on a structural surface, the resilient spring contact being enclosed within the connector body when the connector body is attached to the structural surface and the resilient spring contact electrically contacts the data trace within the connector body;

forming a gap in a base portion of a side wall of the connector body for ingress of the data trace into an interior of the connector body, the gap existing between a bottom edge of the side wall and the structural surface when the connector body is attached to the structural surface; and attaching a connector arrangement to the connector body, the connector arrangement being configured to couple the resilient spring contact to a system.

19. The method of claim 18, further comprising:

disposing a seal in the gap, the seal being configured to prevent moisture from entering into an interior of the connector body.

20. The electrical connector assembly of claim 1, wherein the resilient spring contact comprises a flattened U-shaped band that defines a convex shape with upturned ends.

21. The electrical connector assembly of claim 1, wherein the connector body comprises a plurality of side walls and an upper wall connected to the side walls, wherein the resilient spring contact is enclosed within the plurality of side walls and the upper wall when the connector body is attached to the structural surface with the side walls abutting the structural surface.

22. The electrical connector assembly of claim 1, wherein a bottom edge of side walls of the connector body adjacent the gap completely contacting the structural surface when the connector body is attached to the structural surface.

* * * * *